US009197008B1

(12) United States Patent
Myong

(10) Patent No.: US 9,197,008 B1
(45) Date of Patent: Nov. 24, 2015

(54) ELECTRICAL ASSEMBLY HAVING A THREADED COUPLING NUT AND RETAINING RING

(71) Applicant: Tyco Electronics Corporation, Berwyn, PA (US)

(72) Inventor: Inho Myong, Newark, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/468,802

(22) Filed: Aug. 26, 2014

(51) Int. Cl.
*H01R 4/38* (2006.01)
*H01R 13/58* (2006.01)
*H01R 13/621* (2006.01)

(52) U.S. Cl.
CPC ..... *H01R 13/5841* (2013.01); *H01R 13/621* (2013.01)

(58) Field of Classification Search
CPC ..... H01R 13/62933; H01R 13/623; H01R 13/622; H01R 13/625; H01R 2103/00; H01R 13/658
USPC ..... 439/310–314, 317–318, 320–322, 578, 439/905
See application file for complete search history.

(56) References Cited

U.S. PATENT DOCUMENTS 4,443,052 A * 4/1984 Eaby ..... H01R 13/622 439/322
5,580,278 A * 12/1996 Fowler ..... H01R 13/65802 439/321
6,358,077 B1 * 3/2002 Young ..... H01R 13/622 439/321
7,892,005 B2 * 2/2011 Haube ..... H01R 13/641 439/315
8,376,769 B2 * 2/2013 Holland ..... H01R 13/622 439/322
8,435,066 B2 5/2013 Myong et al.
8,562,366 B2 * 10/2013 Purdy ..... H01R 9/0524 439/322
8,662,911 B2 * 3/2014 Blew ..... F16C 19/00 439/322
8,808,019 B2 * 8/2014 Paglia ..... H01R 13/6583 439/322
8,992,148 B2 * 3/2015 Schafer ..... H01R 13/622 285/92

* cited by examiner

*Primary Examiner* — Thanh Tam Le

(57) ABSTRACT

An electrical assembly includes a connector body extending along a body axis between a mating end and a cable end. The connector body has a body groove at the mating end having a deep groove section and a shallow groove section. A retaining ring is received in the body groove that is compressible between a relaxed state and a compressed state. The retaining ring is able to be compressed to the compressed state when aligned with the deep groove section and is blocked from being compressed to the compressed state when aligned with the shallow groove section. A coupling nut is rotatable about the mating end of the connector body and is configured to be coupled to a receiving connector. The coupling nut has a coupling nut groove receiving the retaining ring when the retaining ring is in the relaxed state.

20 Claims, 3 Drawing Sheets

ELECTRICAL ASSEMBLY HAVING A THREADED COUPLING NUT AND RETAINING RING

BACKGROUND OF THE INVENTION

The subject matter herein relates generally to electrical assemblies having threaded coupling nuts for securing connectors or connector pieces together.

Some conventional electrical connectors are secured together using a threaded coupling nut. For example, some applications include a male connector connected to a female connector using a threaded coupling nut. Other applications include a backshell or adaptor coupled to a front, mating piece using a threaded coupling nut. The threaded coupling nut is freely rotatable about an end of one connector or connector piece. The threaded coupling nut typically has internal threads that are threadably coupled to external threads of another connector or connector piece. Some known coupling nuts are retained by retaining rings, such as C-shaped retaining rings, which are coupled to an end of the connector or connector piece and that engage the coupling nut to secure the coupling nut to the connector or connector piece. For example, the retaining ring may be received in a groove in the connector or connector piece and in a groove in the coupling nut to capture the coupling nut to the connector or connector piece. The groove in the connector or connector piece is deep enough to allow the retaining ring to compress into the groove to allow the coupling nut to pass over the retaining ring until the groove in the coupling nut is aligned with the retaining ring, at which time the retaining ring is intended to snap outward into the groove in the coupling nut.

However, such systems are not without disadvantages. For example, during installation, when the coupling nut is tightened onto the other connector or connector piece, the forces on the coupling nut may cause the coupling nut to distort or deform, which may push the retaining ring back into the groove in the connector or connector piece, leading to separation of the coupling nut. The forces may cause the retaining ring to distort or shift back into the groove in the connector or connector piece, leading to separation of the coupling nut.

A need remains for a retention system that reduces or eliminates collapsing of the retaining ring and/or separation of the coupling nut from the connector or connector piece.

BRIEF SUMMARY OF THE INVENTION

In one embodiment, an electrical assembly is provided that includes a connector body extending along a body axis between a mating end and a cable end. The connector body has a body groove at the mating end having a deep groove section and a shallow groove section forward of the deep groove section along the body axis. A retaining ring is received in the body groove. The retaining ring is compressible between a relaxed state and a compressed state. The retaining ring is able to be compressed to the compressed state when aligned with the deep groove section and the retaining ring is blocked from being compressed to the compressed state when aligned with the shallow groove section. A coupling nut is rotatable about the mating end of the connector body. The coupling nut is configured to be coupled to a receiving connector. The coupling nut has a coupling nut groove receiving the retaining ring when the retaining ring is in the relaxed state.

Optionally, the connector body may include a step in the body groove defining the shallow groove section. The body groove may include a rear wall along the deep groove section and a front wall along the shallow groove section with an inner wall between the rear wall and the front wall. The front wall may be stepped to define the shallow groove section.

Optionally, the coupling nut may pull the retaining ring forward when the coupling nut is coupled to the receiving connector to align the retaining ring with the shallow groove section.

Optionally, the retaining ring may have a first retaining ring diameter in the relaxed state and a second retaining ring diameter in the compressed state that is smaller than the first retaining ring diameter. The deep groove section may be deep enough to allow the retaining ring to compress to the second retaining ring diameter. The shallow groove section may be shallow enough to block the retaining ring from compressing to the second retaining ring diameter.

Optionally, the retaining ring may have an inner end and an outer end radially outward of the inner end. The inner end may be received in the body groove and the outer end may be received in the coupling nut groove when the retaining ring is in the relaxed state. The outer end may be outside of the coupling nut groove in the compressed state. Optionally, the body groove may include an inner edge at the shallow groove section. The inner edge may block the inner end of the retaining ring from radially inward movement to stop the retaining ring from compressing to the compressed state. The body groove may include a front wall having a front edge and an inner edge at the shallow groove section. The front wall may have a depth defined between an exterior of the connector body and the inner edge. The depth may be less than a thickness of the retaining ring defined between the inner end and the outer end of the retaining ring. The body groove may include a rear wall defining the deep groove section. The rear wall may have a depth defined between the exterior of the connector body and an inner wall of the body groove. The depth of the rear wall may be greater than or equal to the thickness of the retaining ring.

Optionally, the body groove may include a rear wall along the deep groove section and a front wall along the shallow groove section with an inner wall between the rear wall and the front wall. The front wall may have a radially extending deep edge. The front wall may have a radially extending shallow edge. The front wall may have an axially extending inner edge between the deep edge and the shallow edge that defines a step in the body groove. The front wall may have a chamfered edge connecting the inner edge and the deep edge.

In another embodiment, an electrical assembly is provided including a front end connector and a rear end connector coupled to the front end connector. The front end connector has a first end and a second end configured to be mated with a second electrical assembly. The first end has a threaded area. The front end connector has a cable extending from the first end. The rear end connector has a connector body receiving the cable from the first end of the front end connector. The connector body extends along a body axis between a mating end and a cable end. The connector body has a body groove at the mating end. The body groove has a deep groove section and a shallow groove section forward of the deep groove section along the body axis. A retaining ring is received in the body groove. The retaining ring is compressible between a relaxed state and a compressed state, wherein the retaining ring is able to be compressed to the compressed state when aligned with the deep groove section and the retaining ring is blocked from being compressed to the compressed state when aligned with the shallow groove section. A coupling nut is rotatable about the mating end of the connector body. The coupling nut is threadably coupled to the threaded area at the first end of the front end connector. The coupling nut has a coupling nut groove that receives the retaining ring when the retaining ring is in the relaxed state.

DETAILED DESCRIPTION OF SPECIFIC EMBODIMENTS OF THE INVENTION

Figure 1:
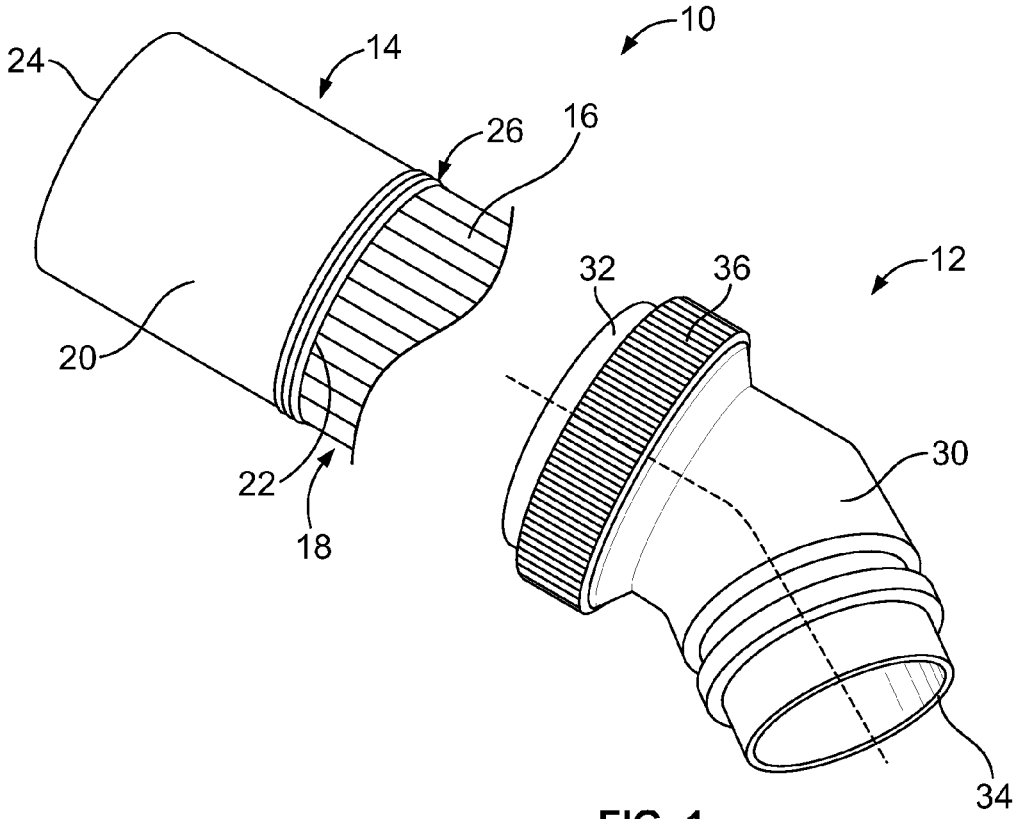
FIG. 1 is an exploded view of an electrical assembly including a connector and a receiving connector.

FIG. 1 is an exploded view of an electrical assembly 10. The electrical assembly 10 includes a connector 12 and a receiving connector 14 that receives the connector 12 when assembled or mated. Optionally, the electrical assembly 10 may be used in a system to transmit data and/or power. The electrical assembly 10 may be suitable for use in the aerospace industry, automotive industry or the like. Optionally, the connector 12 and receiving connector 14 may both be separate electrical connectors that are electrically connected together, such as to connect cables and/or devices of an electrical system.

Alternatively, as in the illustrated embodiment, the connector 12 and the receiving connector 14 may be separate pieces that are joined or coupled together to define a single electrical connector that is then configured to be mated or plugged to another electrical connector. In such embodiments, the connector 12 may define a rear end portion or rear end connector 12 and the receiving connector may define a front end portion or a front end connector 14. For example, the rear end connector 12 may define a backshell, connector accessory or an adapter that directs wires 16 of a cable 18 into the front end connector 14, which holds contacts or terminals (not shown) for mating with another electrical connector. The rear end connector 12 may provide strain relief for the wires 16 and the cable 18. The rear end connector 12 may be electrically grounded to the cable 18, such as a cable braid or cable shield, and may be electrically grounded to the front end connector 14.

The receiving connector 14 includes a connector body 20 with a mating or first end 22 and a second end 24 opposite the first end 22. The connector 12 is configured to be coupled to the first end 22. In an exemplary embodiment, the receiving connector 14 has a threaded area 26 at the first end 22. The connector 12 is threadably coupled to the threaded area 26, such as by a threaded coupling nut. In the illustrated embodiment, the connector 12 and the receiving connector 14 are connector pieces joined together to define a single electrical connector configured to be mated with another electrical connector at the second end 24. The wires 16 extend from the first end 22 as a wire bundle and pass through the connector 12. Alternatively, the connectors 12, 14 may be separate connectors mated together and the cable may extend from the second end 24 of the receiving connector 14 with a separate cable extending from the connector 12.

The connector 12 includes a connector body 30 with a mating end 32 and a cable end 34 opposite the mating end 32. The mating end 32 of the connector 12 includes a threaded coupling nut 36 that is threadably coupled to the threaded area 26 at the mating end 22 of the receiving connector 14. In the illustrated embodiment, the connector 12 and the receiving connector 14 are connector pieces joined together to define a single electrical connector. The cable 18 passes through the connector 12 into the receiving connector 14 where the wires are terminated to corresponding contacts or terminals (not shown). The connector 12 secures the cable 18 to the receiving connector 14 and protects the wires 16 from forces that may be imposed on the cable 18 and/or the electrical assembly 10. The connector 12 prevents the cable 18 from being damaged from external elements. The connector 12 may also provide electromagnetic shielding for the wires 16. For example, the cable end 34 may be terminated to a cable braid or cable shield of the cable 18. For example, the cable end 34 may include a corrosion-resisting steel termination band or the like. The cable end 34 may include a cable tie, a saddle clamp, a cable bundling string, and/or a heat-shrinkable boot to secure the cable end 34 to the cable 18.

Figure 2:
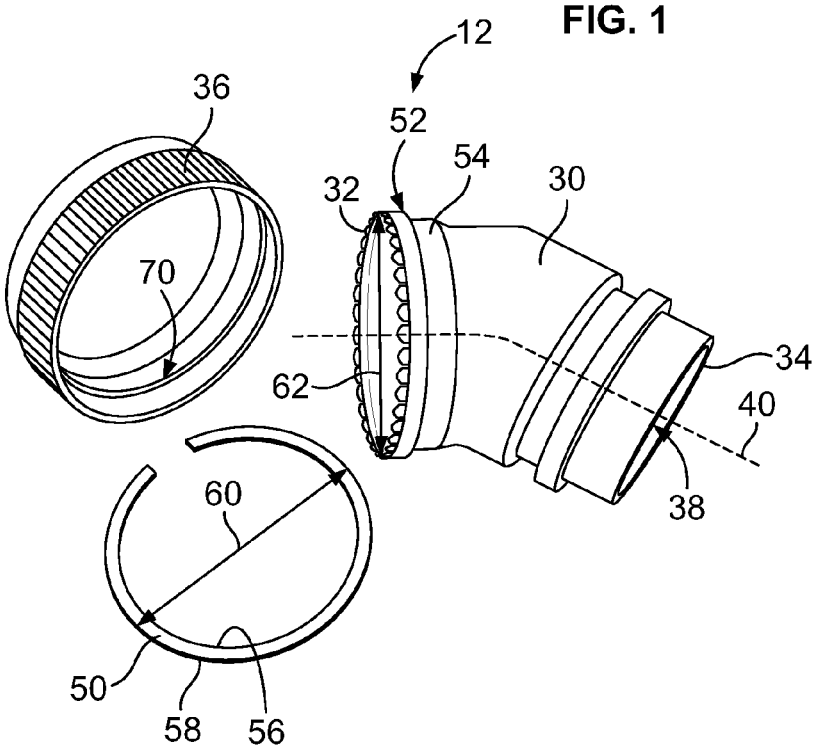
FIG. 2 is an exploded view of the connector.

FIG. 2 is an exploded view of the connector 12. The connector 12 includes a cavity 38 through the connector body 30 between the mating end 32 and the cable end 34. The cavity 38 extends along a body axis 40 of the connector body 30. In the illustrated embodiment, the connector body 30 is angled such that the body axis 40 at the mating end 32 is non-parallel to the body axis 40 at the cable end 34. The cable 18 (shown in FIG. 1) is directed through the cavity 38 between the mating end 32 and the cable end 34. Alternatively, the cable 18 may be terminated to contacts or terminals (not shown) within the connector body 30.

The coupling nut 36 is coupled to the mating end 32 using a retaining ring 50. The retaining ring 50 may be a C-shaped split ring that may be snapped onto the mating end 32. For example, in an exemplary embodiment, the connector body 30 includes a body groove 52 in an exterior 54 of the connector body 30 at or near the mating end 32 that receives the retaining ring 50. Similarly, the coupling nut 36 includes a coupling nut groove 70 that receives the retaining ring 50. The body groove 52 and coupling nut groove 70 extend circumferentially around the connector body 30 and coupling nut 36, respectively.

The retaining ring 50 extends between an inner end 56 and an outer end 58 radially outward of the inner end 56. The inner end 56 is received in the body groove 52. The retaining ring 50 is generally circular in shape between the opposed ends 56, 58. The retaining ring 50 is illustrated in a relaxed state, in which the retaining ring 50 has a diameter 60 slightly larger than a body diameter 62 of the exterior 54 of the connector body 30. As such, a radially outer portion of the retaining ring 50 is able to extend outward of the exterior 54 of the connector body 30 to capture the coupling nut 36. For example, the outer end 58 is positioned outside of the exterior 54 in the relaxed state to engage the coupling nut 36.

The retaining ring 50 may be expanded to an expanded state by spreading the ends 56, 58 apart, such as to fit over the connector body 30 to load the retaining ring 50 into the body groove 52. The retaining ring 50 may be compressed to a compressed state by pressing the ends 56, 58 toward each other, such as to allow the coupling nut 36 to be loaded into position at the mating end 32. Once the coupling nut 36 is properly positioned, the retaining ring 50 springs back to the relaxed state and is received in the coupling nut 36 to capture the coupling nut 36 on the connector body 30. The diameter 60 changes from the relaxed state to the expanded state and from the relaxed state to the compressed state.

Figure 3:
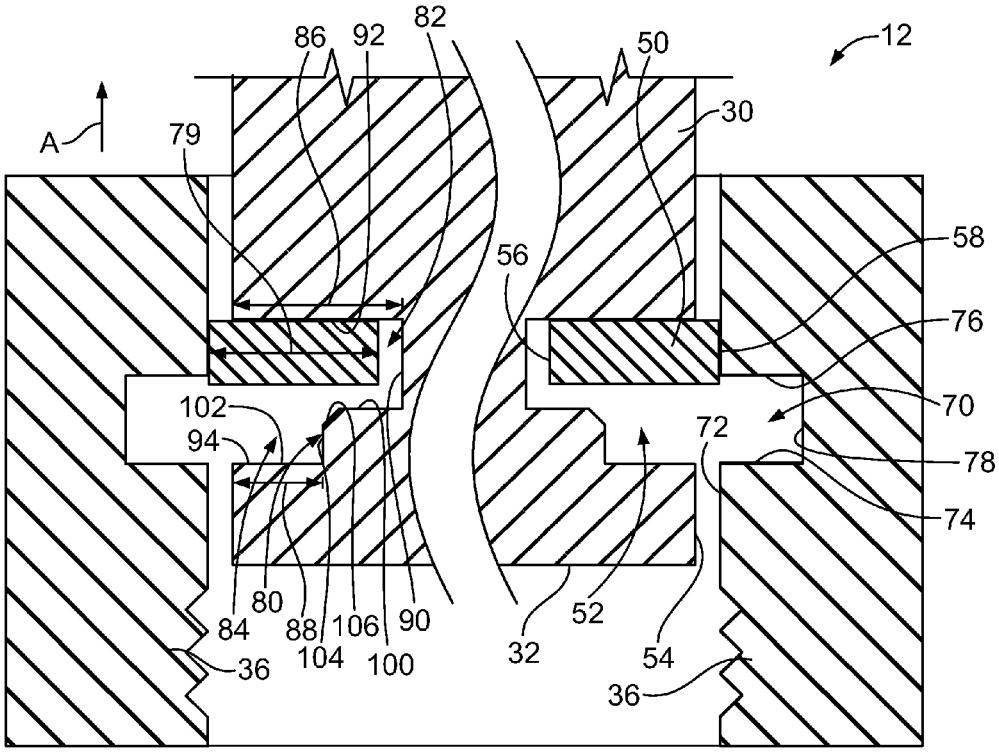
FIG. 3 is a cross sectional view of a portion of the connector showing a coupling nut coupled to a connector body using a retaining ring, with the retaining ring shown in a compressed state.
Figure 4A:
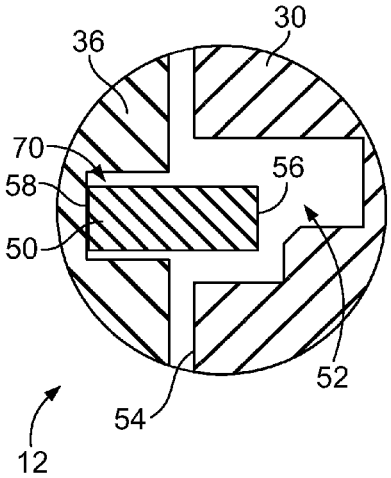
FIGS. 4A and 4B are sectional views of a left portion and a right portion, respectively, of the connector showing the retaining ring in a relaxed state.
Figure 4B:
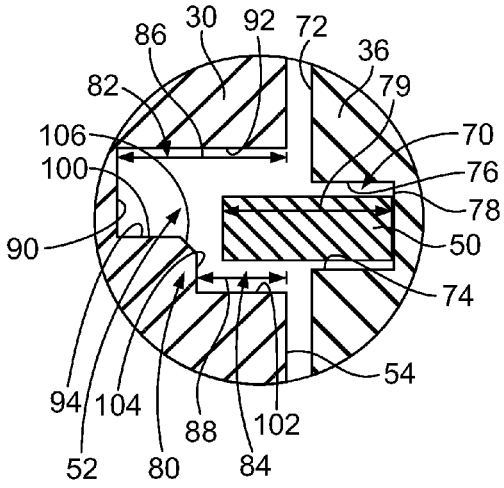

FIG. 3 is a cross sectional view of a portion of the connector 12 showing the coupling nut 36 coupled to the connector body 30 using the retaining ring 50. FIG. 3 illustrates the retaining ring 50 in the compressed state, such as during assembly of the connector 12. FIGS. 4A and 4B are cross sectional views of a left portion and a right portion, respectively, of the connector 12 showing the retaining ring 50 in a relaxed state. The retaining ring 50 is received in the body groove 52 and is used to hold the coupling nut 36 on the connector body 30 when the retaining ring 50 is coupled to the coupling nut 36. For example, when the inner end 56 of the retaining ring 50 is received in the body groove 52 and the outer end 58 is received in the coupling nut 36 (FIG. 4), the coupling nut 36 is secured to the connector body 30.

During assembly (FIG. 3), the coupling nut 36 is loaded into a locked position on the connector body 30. For example, the coupling nut 36 may be loaded onto the mating end 32 from the front in a loading direction (Arrow A). Alternatively, the coupling nut 36 may be initially positioned on the connector body 30 rearward of the mating end 32 and then pulled or loaded forward over the retaining ring 50. The retaining ring 50 is held in the compressed state (FIG. 3) during loading of the coupling nut 36 to the locked position.

The coupling nut 36 includes a coupling nut groove 70 in an interior 72 of the coupling nut 36. During assembly, the outer end 58 of the retaining ring 50 is compressed below the interior 72 of the coupling nut 36, and may be below the exterior 54 of the connector body 30, to allow the coupling nut 36 to slide into position on the connector body 30. Optionally, the outer end 58 may be spring biased against the interior 72 of the coupling nut 36. Once the coupling nut 36 is properly axially positioned, the coupling nut groove 70 receives the outer end 58 of the retaining ring 50. The retaining ring 50 snaps outward from the compressed state to the relaxed state into the coupling nut groove 70.

The coupling nut groove 70 may be rectangular in cross section. The coupling nut groove 70 includes a front wall 74, a rear wall 76 and a connecting wall 78 between the front wall 74 and the rear wall 76. Optionally, the coupling nut groove 70 may be slightly wider than a thickness 79 of the retaining ring 50. The coupling nut 36 may be free spinning or rotating on the retaining ring 50 to allow threadably coupling the coupling nut 36 to the receiving connector 14 (shown in FIG. 1). Unresolved relaxation in the final state (FIG. 4) keeps the retaining ring 50 in contact with the connecting wall 78 of the coupling nut groove 70. For example, the diameter of the coupling nut groove 70 along the connecting wall 78 may be less than a relaxed diameter of the retaining ring 50 such that the retaining ring 50 is unable to return fully to the relaxed state, ensuring that the retaining ring 50 is biased against the connecting wall 78.

In an exemplary embodiment, the connector body 30 includes a step 80 in the body groove 52 to define a deep groove section 82 and a shallow groove section 84. Optionally, the shallow groove section 84 is forward of the deep groove section 82. As such, when the coupling nut 36 is being tightened to the receiving connector 14, the coupling nut 36 pulls the retaining ring 50 forward in alignment with the shallow groove section 84. The deep groove section 82 has a depth 86 that is deeper than a depth 88 of the shallow groove section 84. The depth 86 of the deep groove section 82 is deep enough to allow the retaining ring 50 to compress to the compressed state. The depth 86 of the deep groove section 82 is greater than or equal to the thickness 79 of the retaining ring 50 to allow all or substantially all of the retaining ring 50 to be contained within the body groove 52. The shallow groove section 84 is shallow enough to block the retaining ring 50 from compressing to the compressed state.

The body groove 52 includes a radially inner wall 90, a rear wall 92 along the deep groove section 82 and a front wall 94 along the shallow groove section 84. The inner wall 90 extends between the rear wall 92 and the front wall 94. The front wall 94 is stepped to define the step 80 and the shallow groove section 84. The diameter of the step 80 is smaller than the inner diameter of retaining ring 50, which allows the retaining ring 50 to surround the step 80 when the retaining ring 50 is expanded. However, the diameter of the step 80 is large enough to ensure that the retaining ring 50 remains in the coupling nut groove 70. The front wall 94 includes multiple segments. For example, the front wall 94 includes a radially extending deep edge 100, a radially extending shallow edge 102, an axially extending inner edge 104 between the deep edge 100 and the shallow edge 102 and a chamfered edge 106 connecting the inner edge 104 and the deep edge 100. The chamfered edge 106 may be angled between the inner edge 104 and the deep edge 100. Alternatively, the chamfered edge 106 may be radiused or curved between the inner edge 104 and the deep edge 100. The angled or radiused shape of the chamfered edge 106 allows the retaining ring 50 to be self-centered in the body groove 52 to ensure that at least a portion of the retaining ring 50 is located in the coupling nut groove 70 (e.g., the retaining ring 50 is unable to back too far into the body groove 52 that the retaining ring 50 is no longer positioned in the coupling nut groove 70). The inner edge 104 defines the step 80 in the body groove 52. The shallow edge 102 defines a front edge (which may be referred to hereinafter as a front edge 102) for the retaining ring 50.

During use, the coupling nut 36 presses the retaining ring 50 forward against the front edge 102 when the coupling nut 36 is tightened to the receiving connector 14. The length of the front edge 102 between the exterior 54 of the connector body 30 and the inner edge 104 defines the depth 88 of the shallow groove section 84. The depth 88 is less than the thickness 79 of the retaining ring 50 such that, when the retaining ring 50 is axially aligned with the inner edge 104, the outer end 58 of the retaining ring 50 is positioned radially outward of the exterior 54 of the connector body 30. The inner edge 104 stops or blocks the retaining ring 50 from compressing entirely into the body groove 52 when the retaining ring 50 is axially aligned with the inner edge 104 in the shallow groove section 84. The inner edge 104 blocks the inner end 56 of the retaining ring 50 from radially inward movement to stop the retaining ring 50 from compressing to the compressed state. The coupling nut 36 is unable to be detached or separated from the connector body 30 when the retaining ring 50 is centered in the body groove 52 by the inner edge 104.

Figure 5:
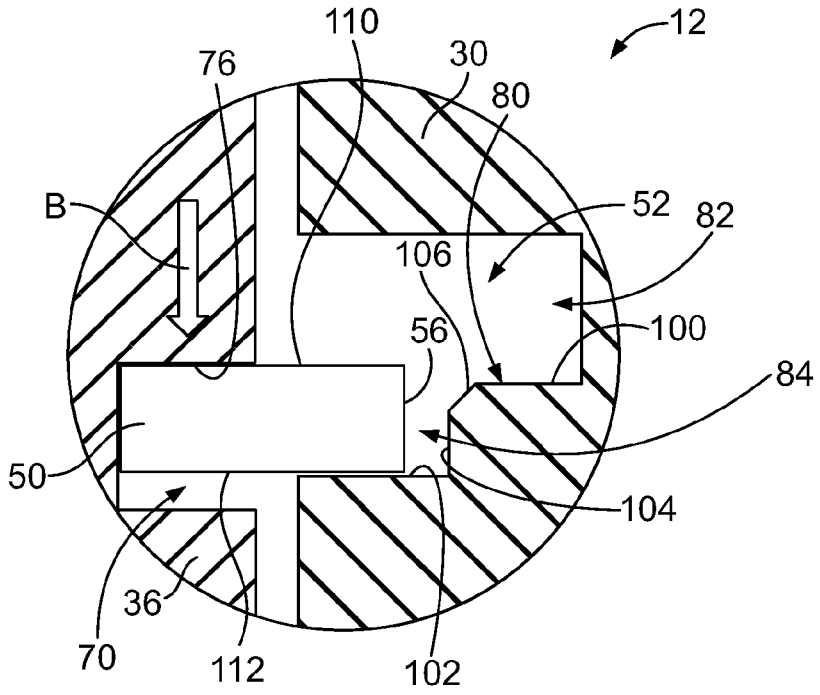
FIG. 5 illustrates a portion of the connector showing the coupling nut being pulled forward.
Figure 6:
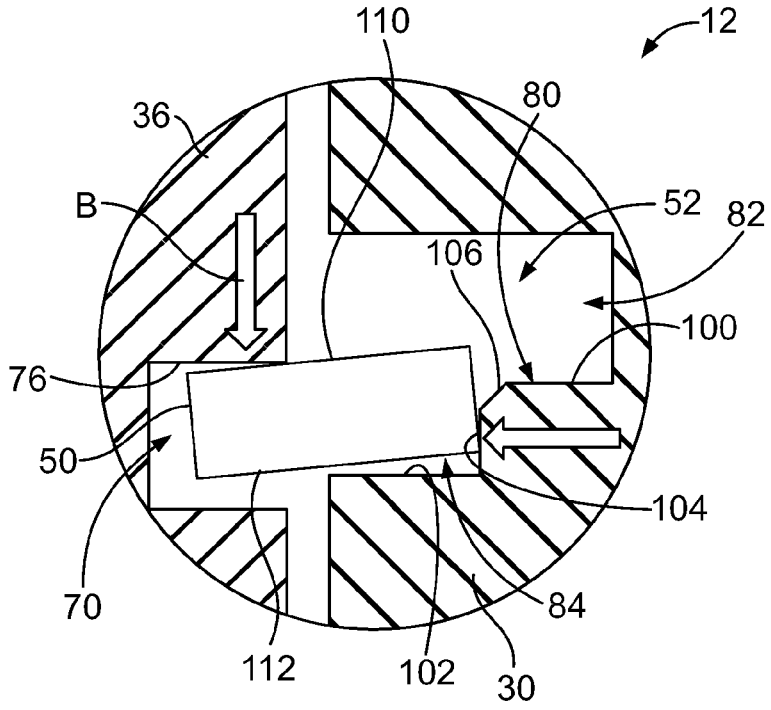
FIG. 6 is another view of the connector showing the coupling nut being pulled forward.

FIG. 5 illustrates a portion of the connector 12, showing the coupling nut 36 being pulled forward in the direction of arrow B, such as when the coupling nut 36 is being tightened to the receiving connector 14 (shown in FIG. 1). FIG. 6 is another view of the connector 12 showing the coupling nut 36 being pulled forward in the direction of arrow B.

When the retaining ring 50 is released into the coupling nut groove 70, the retaining ring 50 is at or near the relaxed state. The chamfered edge 106 transitions between the deep groove section 82 and the shallow groove section 84 to provide clearance for the retaining ring 50 to snap to the relaxed state without interference with the deep edge 100. The chamfered edge 106 allows the retaining ring 50 to be self-centering and avoids jamming or catching on the front wall 94. For example, the chamfered edge 106 eliminates catching when the retaining ring 50 is only partially extended or is off-centered during tightening of the coupling nut 36. As the retaining ring 50 clears the deep edge 100 and is aligned with the chamfered edge 106, the angle or radius of the chamfered edge 106 forces the retaining ring 50 to continue to expand or otherwise transition to the inner edge 104. For example, the chamfered edge 106 pushes or guides the retaining ring 50 outward and/or forward. The chamfered edge 106 has a smaller diameter than the inner diameter of the retaining ring 50 in the expanded state to ensure that the retaining ring 50 does not catch on the deep edge 100 as the retaining ring 50 is pressed forward, such as during tightening. The inner edge 104 defines an anti-collapsing feature to block or restrict collapsing of the retaining ring 50 from the expanded state.

In alternative embodiments, rather than transitioning to the flat inner edge 104, the chamfered edge 106 may define the inner edge 104 such that the chamfered edge 106/inner edge 104 is angled or radiused between the deep edge 100 and the shallow edge 102. For example, no portion of the inner edge 104 may be horizontal, but rather the entire inner edge 104 may be angled or curved. Such embodiment ensures that the retaining ring 50 does not get hung or catch on a sharp edge. The angled or radiused shape of the chamfered edge 106/inner edge 104 allows the retaining ring 50 to be self-centered in the body groove 52 to ensure that at least a portion of the retaining ring 50 is located in the coupling nut groove 70.

Once the retaining ring 50 snaps outward, the retaining ring 50 is free to move forward into the shallow groove section 84. For example, as the coupling nut 36 is pulled forward, the rear wall 76 of the coupling nut 36 engages a rear 110 of the retaining ring 50 and forces the retaining ring 50 forward into axial alignment with the shallow groove section 84. Optionally, approximately half of the retaining ring 50 is in the coupling nut groove 70 and about half of the retaining ring 50 is in the body groove 52.

As the coupling nut 36 is tightened (FIG. 5), the coupling nut 36 engages the retaining ring 50 and a front 112 of the retaining ring 50 may be pressed into the front edge 102 of the body groove 52. Further tightening of the coupling nut 36 may cause the retaining ring 50 to distort in shape (FIG. 6). For example, the retaining ring 50 may be pressed inward into the body groove 52. With conventional systems, the retaining ring 50 may compresses beyond a critical amount to an extent that the retaining ring 50 slips out of the coupling nut groove 70 allowing the coupling nut 36 to separate from the connector body 30. However, with the connector 12, the step 80 is positioned to block radially inward compression or movement of the retaining ring 50 beyond a critical amount, thus ensuring that the retaining ring 50 remains at least partially in the coupling nut groove 70. The step 80 defines an anti-separation feature for the coupling nut 36. The retaining ring 50 is stopped or blocked from compressing entirely into the body groove 52 when the retaining ring 50 is axially aligned with the inner edge 104 in the shallow groove section 84. The inner edge 104 blocks the inner end 56 of the retaining ring 50 from radially inward movement to stop the retaining ring 50 from compressing to the compressed state. The diameter of the inner edge 104 may be slightly less than the inner diameter of the retaining ring 50 in the expanded state. The coupling nut 36 is unable to be detached or separated from the connector body 30. Optionally, the width of the step 80 does not need to be as wide as the retaining ring 50, as the retaining ring 50 is able to extend over the chamfered edge 106 and even the body groove 52. As long as some portion of the retaining ring 50 overlaps the step 80 as the retaining ring 50 is pressed against the front edge 102, the step 80 will block the retaining ring 50 from collapsing out of the coupling nut groove 70.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical assembly comprising:

a connector body extending along a body axis between a mating end and a cable end, the connector body having a body groove at the mating end, the body groove having a deep groove section and a shallow groove section forward of the deep groove section along the body axis;

a retaining ring received in the body groove, the retaining ring being compressible between a relaxed state and a compressed state, wherein the retaining ring is able to be compressed to the compressed state when aligned with the deep groove section and wherein the retaining ring is blocked from being compressed to the compressed state when aligned with the shallow groove section; and a coupling nut rotatable about the mating end of the connector body, the coupling nut being configured to be coupled to a receiving connector, the coupling nut having a coupling nut groove receiving the retaining ring when the retaining ring is in the relaxed state.

2. The electrical assembly of claim 1, wherein the connector body includes a step in the body groove defining the shallow groove section.

3. The electrical assembly of claim 1, wherein the connector body includes a chamfered edge between the shallow groove section and the deep groove section.

4. The electrical assembly of claim 1, wherein the body groove includes a rear wall along the deep groove section and a front wall along the shallow groove section with an inner wall between the rear wall and the front wall, the front wall being stepped to define the shallow groove section.

5. The electrical assembly of claim 1, wherein the coupling nut pulls the retaining ring forward when the coupling nut is coupled to the receiving connector to align the retaining ring with the shallow groove section.

6. The electrical assembly of claim 1, wherein the retaining ring has a first retaining ring diameter in the relaxed state and a second retaining ring diameter in the compressed state that is smaller than the first retaining ring diameter, the deep groove section being deep enough to allow the retaining ring to compress to the second retaining ring diameter, the shallow groove section being shallow enough to block the retaining ring from compressing to the second retaining ring diameter.

7. The electrical assembly of claim 1, wherein the retaining ring has an inner end and an outer end radially outward of the inner end, the inner end being received in the body groove, the outer end being received in the coupling nut groove when the retaining ring is in the relaxed state, the outer end being outside of the coupling nut groove in the compressed state.

8. The electrical assembly of claim 7, wherein the body groove includes an inner edge at the shallow groove section, the inner edge blocking the inner end of the retaining ring from radially inward movement to stop the retaining ring from compressing to the compressed state.

9. The electrical assembly of claim 7, wherein the body groove includes a front wall having a front edge and an inner edge at the shallow groove section, the front wall having a depth defined between an exterior of the connector body and the inner edge, the depth being less than a thickness of the retaining ring defined between the inner end and the outer end of the retaining ring.

10. The electrical assembly of claim 9, wherein the body groove includes a rear wall defining the deep groove section, the rear wall having a depth defined between the exterior of the connector body and an inner wall of the body groove, the depth of the rear wall being greater than or equal to the thickness of the retaining ring.

11. The electrical assembly of claim 1, wherein the body groove includes a rear wall along the deep groove section and a front wall along the shallow groove section with an inner wall between the rear wall and the front wall, the front wall having a radially extending deep edge, the front wall having a radially extending shallow edge, and the front wall having an axially extending inner edge between the deep edge and the shallow edge that defines a step in the body groove.

12. The electrical assembly of claim 11, wherein the front wall includes a chamfered edge connecting the inner edge and the deep edge.

13. An electrical assembly comprising:

a front end connector having a first end and a second end configured to be mated with a second electrical assembly, the first end having a threaded area, the front end connector having a cable extending from the first end;

a rear end connector coupled to the front end connector, the rear end connector having a connector body receiving the cable from the first end of the front end connector, the connector body extending along a body axis between a mating end and a cable end, the connector body having a body groove at the mating end, the body groove having a deep groove section and a shallow groove section forward of the deep groove section along the body axis;

a retaining ring received in the body groove, the retaining ring being compressible between a relaxed state and a compressed state, wherein the retaining ring is able to be compressed to the compressed state when aligned with the deep groove section and wherein the retaining ring is blocked from being compressed to the compressed state when aligned with the shallow groove section; and a coupling nut rotatable about the mating end of the connector body, the coupling nut being threadably coupled to the threaded area at the first end of the front end connector, the coupling nut having a coupling nut groove receiving the retaining ring when the retaining ring is in the relaxed state.

14. The electrical assembly of claim 13, wherein the connector body includes a step in the body groove defining the shallow groove section.

15. The electrical assembly of claim 13, wherein the connector body includes a chamfered edge between the shallow groove section and the deep groove section.

16. The electrical assembly of claim 13, wherein the body groove includes a rear wall along the deep groove section and a front wall along the shallow groove section with an inner wall between the rear wall and the front wall, the front wall being stepped to define the shallow groove section.

17. The electrical assembly of claim 13, wherein the coupling nut pulls the retaining ring forward when the coupling nut is coupled to the receiving connector to align the retaining ring with the shallow groove section.

18. The electrical assembly of claim 13, wherein the retaining ring has a first retaining ring diameter in the relaxed state and a second retaining ring diameter in the compressed state that is smaller than the first retaining ring diameter, the deep groove section being deep enough to allow the retaining ring to compress to the second retaining ring diameter, the shallow groove section being shallow enough to block the retaining ring from compressing to the second retaining ring diameter.

19. The electrical assembly of claim 13, wherein the retaining ring has an inner end and an outer end radially outward of the inner end, the inner end being received in the body groove, the outer end being received in the coupling nut groove when the retaining ring is in the relaxed state, the outer end being outside of the coupling nut groove in the compressed state.

20. The electrical assembly of claim 19, wherein the body groove includes an inner edge at the shallow groove section, the inner edge blocking the inner end of the retaining ring from radially inward movement to stop the retaining ring from compressing to the compressed state.

* * * * *